US005701881A

United States Patent [19]

Hyun

[11] Patent Number: 5,701,881

[45] Date of Patent: Dec. 30, 1997

[54] FIRE GRATE HAVING FLUCTUATIONAL PROFILE IN CIRCUMFERENTIAL DIRECTION THEREOF

[76] Inventor: Kwangsoo Hyun, 8-30 Nhoyoo-1-Dong, Kwangjin-Gu Seoul, 143-301, Rep. of Korea

[21] Appl. No.: 535,407

[22] Filed: Sep. 28, 1995

Related U.S. Application Data

[60] Continuation-in-part of Ser. No. 373,959, Jan. 17, 1995, abandoned, which is a division of Ser. No. 128,071, Sep. 28, 1993, abandoned.

[51] Int. Cl.[6] ..... F23H 1/02

[52] U.S. Cl. ..... 126/163 R; 110/166; 110/300; 126/152 R

[58] Field of Search ..... 110/166, 300; 126/152 R, 163 A, 163 R, 173; 122/376; 431/328

[56] References Cited

U.S. PATENT DOCUMENTS

| | | | |
|---|---|---|---|
| 27,876 | 11/1860 | Smith | 126/152 R |
| 916,395 | 3/1909 | Dwight et al. | 110/294 X |
| 1,497,490 | 6/1924 | Dullmann | 126/152 R |
| 3,191,591 | 6/1965 | Bennett | 126/152 R |
| 4,924,847 | 5/1990 | Patenaude | 110/300 X |
| 5,137,010 | 8/1992 | Whitfield et al. | 110/285 X |

FOREIGN PATENT DOCUMENTS

| | | | |
|---|---|---|---|
| 600780 | 2/1926 | France | 126/152 |

*Primary Examiner*—Henry A. Bennett
*Assistant Examiner*—Susanne C. Tinker

[57] ABSTRACT

At least one ring-shaped fin is disposed on the upper surface of a variety of circular planform stationary fire grate having a multiplicity of ash discharge openings thereon and for use in combustion chamber of either water jacket or fire brick type cylindrical incinerators. The first version is a circular planform stationary grate having circumferentially fluctuational upper surface contour selectively with at least one fluctuational or fluctuation-free ring-shaped fin arrangements thereon. The second version of the fire grate is a circular planform stationary grate having horizontal and fluctuational concentric rings in combinational fashion in radial direction, the concentric rings being defined by a multiplicity of arc-shaped ash discharge openings. The third version is a circular planform stationary fire grate having plain horizontal upper surface contour with either at least two fluctuation-free fins or at least one fluctuational fin or with combinational fin arrangements of the two fin profiles thereon.

10 Claims, 11 Drawing Sheets

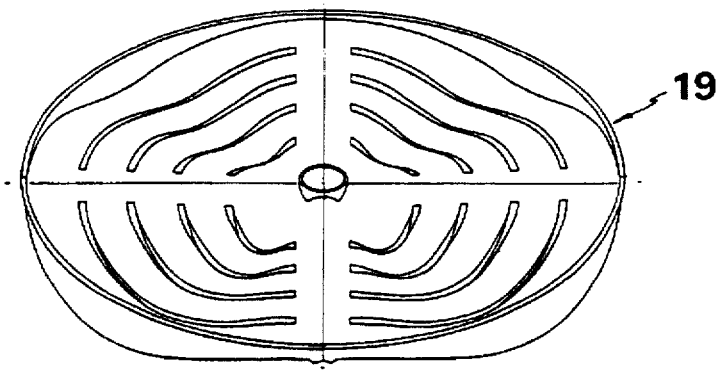
FIG. 2
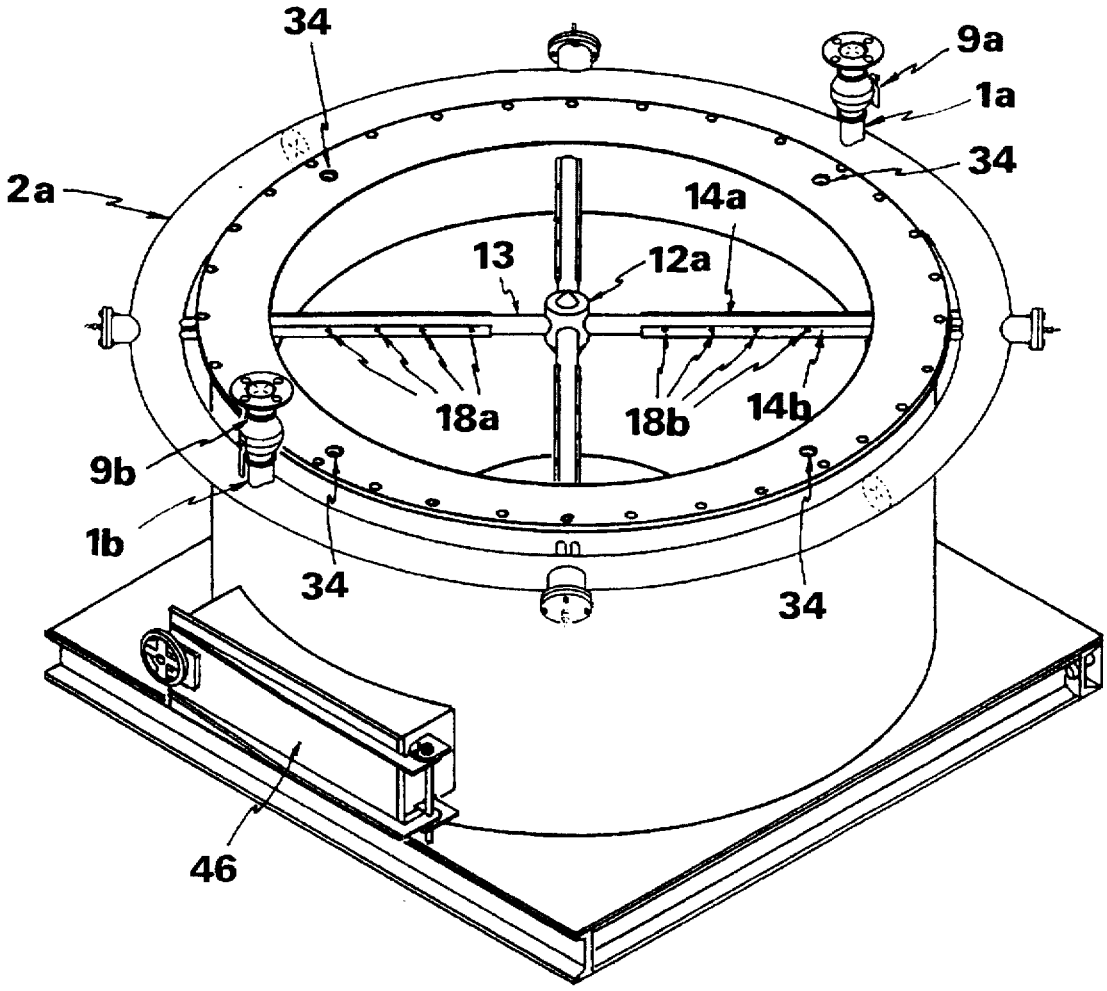

FIRE GRATE HAVING FLUCTUATIONAL PROFILE IN CIRCUMFERENTIAL DIRECTION THEREOF

CROSS-REFERENCES

The present application is a continuation in part of my application Ser. No. 08/373,959 filed Jan. 17, 1995, now abandoned, entitled "Fire Grate Having Fluctuational Profile in Circumferential Direction Thereof," which was a divisional application of my application Ser. No. 08/128,071 filed Sep. 28, 1993, entitled "Merry-Go-Round Agitation Fire Grate Module for Household and Industrial Waste Incinerator Furnaces," abandoned. The present application is related to my application Ser. No. 08/162.465 filed Dec. 07, 1993, entitled "Apparatus for Complete Combustion by Use of Multi-Stage Multi-cycle Composite Air Water Pipings Inducing Complex Incineration/Combustion Mode of Suction, Whirling Flow, Inversion, and Airborne Capturing," abandoned.

BACKGROUND

The present invention relates to a stationary fire grate for stoker type incinerator furnaces, which is placed on the bottom of the combustion chamber of an incinerator furnace of water jacket configuration as well as of a fire brick type incinerator furnace.

Up to the present time, the fire grate used in refuse-burning incinerator furnaces has been of basically plain circular plate type grate with circular holes or fan-shaped openings therein to provide discharge passage to ash sifting of the burning fuels in the upper incineration chamber and also provide air passage therethrough from underneath to supply combustion supporting air to the refuse dumps on the fire grate.

On the other hand, there has been no central and/or radially laid out and circumferentially distributed means for supporting the fire grate to prevent deterioration of structural stiffness of the fire grate exposed to extreme heat of the furnace operating temperature. In this regard, the provision of structural rigidity to the fire grate has been restricted to a passive increase of the structural stiffness of the fire grate in an endeavor to have greater incineration capacity as by increasing the diameter and/or thickness of the fire grate.

Due to the high cost of manufacture of rigorous agitation mechanism in the conventional fire grates for provision of refuse-air contact spaces for air admission underneath the refuse fuel on the fire grate and also due to a poor reliability of the rotary grate owing to complicated structures thereof, the conventional stationary grate used in cylindrical incinerator furnaces is either a single body type fire grate or is formed of a number of angularly and/or radially divided fire grate sectors mounted on a number of mounting brackets to support it/them for small and medium incineration capacity furnaces.

Due to the above mentioned negative design features of the current fire grate configuration, scaling up of the diameter of the incineration chamber of the incinerator furnaces to take care of massive incineration of municipal and industrial refuses has been hindered such that the design of cylindrical incinerator furnaces having water jacket configuration therein has been restricted to small size of the incineration chamber, say, 1 meter at best, which is mainly due to the deterioration of the structural rigidity at high furnace operating temperature. Under these circumstances, the advent of stationary fire grate provided with intrinsic intimate-contact preventing means for providing larger air space between the refuse fuel being incinerated and the upper surface of the fire grate has been anticipated to achieve less number of parts used for an incinerator furnace, resulting in low cost both in manufacture and in maintenance thereof and in enhanced reliability while maintaining agitational effects of the rotary grate.

SUMMARY

The present invention is intended to overcome the above described disadvantages of the conventional circular fire grate of which upper surface is of essentially fluctuation-free profile.

An object of this invention is to provide intimate-contact preventing means for lifting up refuse fuel being burned to stationary fire grate in the combustion chamber of an incineration furnace so that larger refuse-air contact area is achieved for a given refuse volume.

To achieve the object described above a variety of ring-shaped fins in accordance with the present invention has been disposed on the upper surface of the circular stationary fire grates, which is fluctuational or fluctuation-free in the circumferential direction of the fire grate.

The first version of the invention is a generally circular stationary fire grate having ash discharge openings therein, contour of fire grate upper surface in circumferential direction and in radial direction of the fire grate being of fluctuational profile and of fluctuation-free profile respectively.

The second version of the invention is disposing ring-shaped fins, each having different diameter thereof from each other, on the fire grate upper surface of fluctuational profile in circumferential direction of the fire grate. The first aspect of the second version of the invention is to have a first ring-shaped fin disposed on the fire grate upper surface such that center of plan view of the first ring-shaped fin essentially coincides with that of the fire grate. The first fin has contour of fin upper surface of fluctuation-free profile in the circumferential direction of the fire grate. The second aspect is to dispose at least two first ring-shaped fins concentrically on the fire grate upper surface. Each of the fins has contour of fin upper surface of fluctuation-free profile in the circumferential direction of the fire grate. The magnitude of fluctuation-free fin height of each of the first ring-shaped fins may differ from each other. The third aspect is to have a second ring-shaped fin disposed on the fire grate upper surface such that center of plan view of the second ring-shaped fin essentially coincides with that of the fire grate. The second fin has contour of fin upper surface of fluctuational profile in the circumferential direction of the fire grate. The fourth aspect is to have at least two second ring-shaped fins disposed concentrically on the fire grate upper surface. Each of the second fins has contour of fin upper surface of fluctuational profile in the circumferential direction of the fire grate. The magnitude of amplitude and the angular period of fluctuation for each of the fluctuational second ring-shaped fins may be made different from each other at each radial position of the fire grate. Finally the fifth aspect is to have at least one first ring-shaped fin of which contour of fin upper surface is of fluctuation-free profile in the circumferential direction of the fire grate, and at least one second ring-shaped fin of which contour of fin upper surface is of fluctuational profile in the circumferential direction of the fire grate. The first and second fins are combinationally disposed concentrically on the fire grate upper surface.

The third version of the invention is a generally circular fire grate sectored into at least three sectoral portions thereof. Each of the sectoral portions has therein at least two ash discharge openings disposed in radial direction of the fire grate. Plan view of each of the openings is of essentially circular arc having center thereof at center of plan view of the fire grate. Contour of upper surface of at least one selected from a group consisting of (a) a radial fractional portion of the sectoral portion defined by inner rim sector of the fire grate and by innermost said opening, (b) a radial fractional portion of the sectoral portion defined by one of the openings and by its radially neighboring said opening, and (c) a radial fractional portion of the sectoral portion defined by outermost said opening and by outer rim sector of the fire grate, is of fluctuational profile in circumferential direction of the fire grate.

The fourth version of the invention is a generally circular stationary fire grate having ash discharge openings therein, contour of fire grate upper surface being of fluction-free profile in circumferential direction of the fire grate, and at least two first fluctuation-free-bottom ring-shaped fins concentrically disposed on the fire grate upper surface. Contour of fin upper surface of each of the first fluctuation-free-bottom fins is of fluctuation-free profile in the circumferential direction of the fire grate.

The fifth version of the invention is a generally circular stationary fire grate having ash discharge openings therein, contour of fire grate upper surface being of fluctuation-free profile in circumferential direction of the fire grate, and at least one second fluctuation-free-bottom ring-shaped fin disposed on the fire grate upper surface. Contour of fin upper surface of the second fluctuation-free-bottom ring-shaped fin is of fluctuational profile.

The sixth version of the invention is a circular stationary fire grate having ash discharge openings therein, contour of fire grate upper surface being of fluctuation-free profile in circumferential direction of the fire grate, at least one first fluctuation-free-bottom ring-shaped fin, contour of fin upper surface of the first fin being of fluctuation-free profile, and at least one second fluctuation-free-bottom ring-shaped fin, contour of fin upper surface of the second fin being of fluctuational profile. The first and second fluctuation-free-bottom fins are combinationally disposed concentrically on the fire grate upper surface.

In practicing the invention, one mode of manufacture is to make a wood pattern for a fan-shaped angular sector of the invented fire grate. Another recommended mode of manufacture which is especially cost effective in having a wide range of planar diameters of the grate according to the present invention is to make wood patterns for either radially discretized concentric fractions and/or radial fragmentation of aforesaid fan-shaped angular sector for provision of add-on capability for successively increasing fire grate planar diameters for a fire grate of a specific cycle numbers in accordance with the present invention.

BRIEF DESCRIPTION OF THE DRAWINGS

These and other objects, versions, features, aspects, and many of the attendant advantages of this invention will be appreciated more readily as the same become better understood from a reading of the following detailed description when considered in connection with the accompanying drawings, wherein like parts in each of the several figures are identified by the same reference character selectively with lower case alphabetical characters suffixed thereto and with primes superscriped thereto to indicate a portion of an element, and wherein:

FIG. 2 is a bird's eye view of an embodiment of the stationary fire grate in accordance with the present invention and an embodiment of a 4-cycle mode ash sifting lower body whereon the stationary fire grate is mounted;

DETAILED DESCRIPTION OF THE PREFERRED EMBODIMENT

Figure 1:
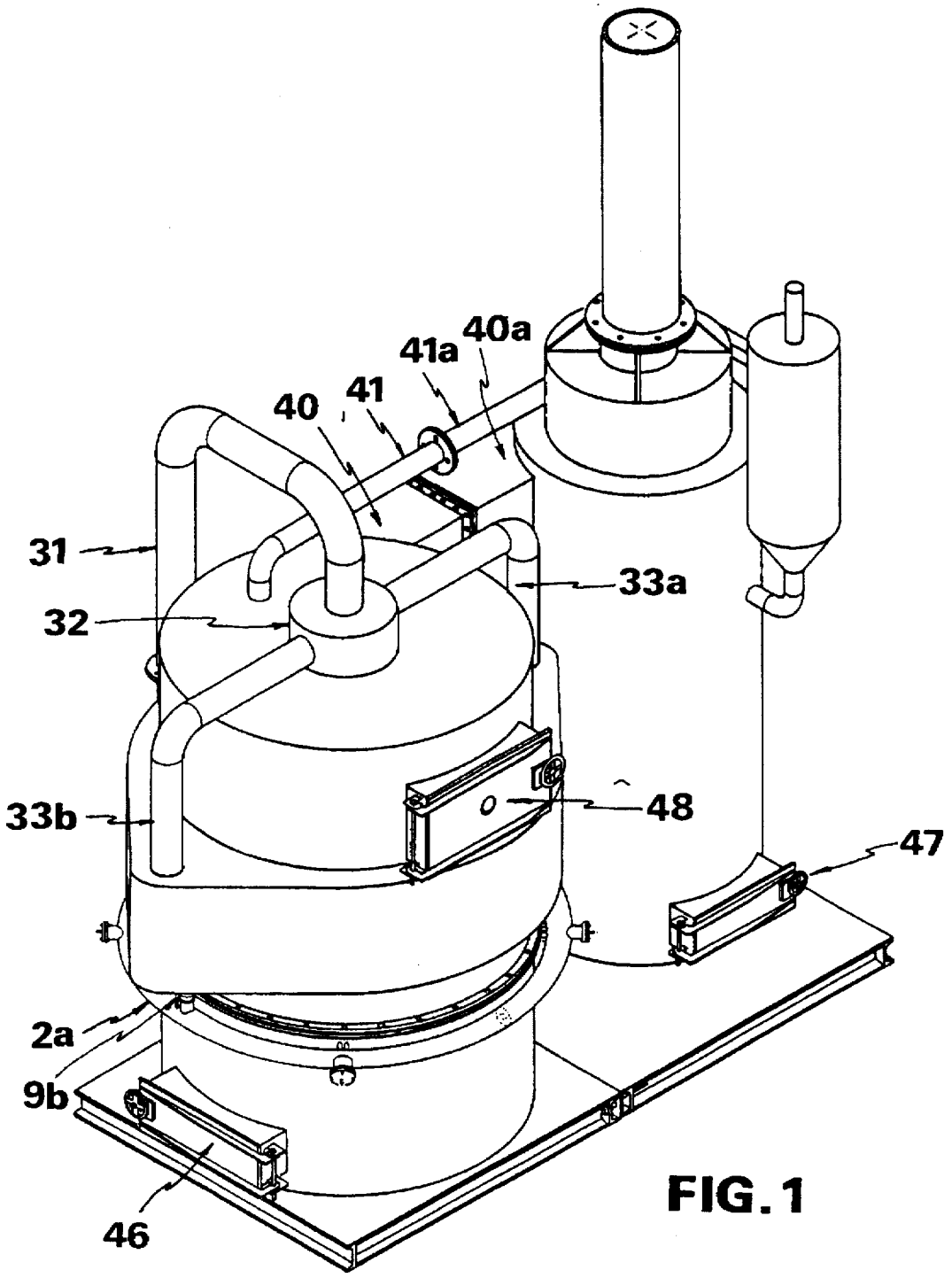
FIG. 1 is a bird's eye view of a modular incinerator furnace of water jacket configuration wherein an embodiment of the stationary fire grate according to the present invention is mounted.

FIG. 1 is a bird's eye view of a 4-cycle mode modular incinerator furnace of water jacket configuration wherein an embodiment of the stationary fire grate according to the present invention is mounted. The figure shows an incinerator furnace in combination of a 4-cycle mode embodiment of the upper complete combustion apparatus of my application Ser. No. 08/162,465 filed Dec. 7, 1993, entitled "Apparatus for Complete Combustion by Use of Multi-Stage Multi-Cycle Composite Air-Water Pipings Inducing Complex Incineration/Combustion Mode of Suction, Whirling Flow, Inversion, and Airborne Capturing," abandoned, and of a 4-cycle mode embodiment of the stationary fire grate of the present invention. The pressurised air generated by a blower fan, placed in rear of the furnace, not shown, is supplied into the upper hoop air plenum through a primary air supply piping 31, an upper air plenum 32, and two secondary air supply pipings 33*a*, 33*b*. Some portion of the pressurized air in the upper hoop air plenum is fed into the upper incineration chamber and the rest of combustion supporting air in the upper hoop air plenum is driven through air intake pipings 1*a*, 1*b* into a torus air plenum 2*a* wherein supplied air is admitted into the bottom and inside of the waste dump through air openings 18*a*, 18*b* shown in FIGS. 2, 4–12 and 15–17 ) on a pair of parallel air pipings 14*a*, 14*b* of each of at least three integral air supply pipings. Here, a couple of air flow rate control valves 9*a*, 9*b* play as air flow rate control regulators. On the other hand, cylindrical shell column on the right hand side is a cyclone separator unit enclosed in a coolant water jacket together with an ancillary hot water storage/circulation reservoir and a chimney. Refuse material feed-in is made through a refuse feed door 48 and the primary ash and secondary dust sifting is made through a ash discharge door 46 and a dust discharge door 47 respectively. The flue gas exhaustion out of the incineration chamber is made through a pair of exhaust duct 40, 40*a*, which is also surrounded by a water jacket respectively, and is driven into the cyclone separator nested in the right hand side shell column. As for the coolant water circulation, the upper incineration chamber is enclosed by inner and outer shells with coolant water in between them so that the heated water is driven into the water jacket between the cyclone separator and outer shell through a coolant water circulation piping 41, 41*a* by the pumping pressure of a water pump mounted on the base plate of the main incinerator furnace, not shown, and connecting the water jacket of the right hand side cyclone separator unit and a water jacket of the ash sifting lower body.

FIG. 2 is a bird's eye view of the stationary fire grate and an embodiment of a 4-cycle mode ash sifting lower body whereon the stationary fire grate in accordance with the present invention is mounted. The figure shows a perspective view of a 4-cycle mode embodiment of a fire grate 19 and an ash sifting lower body whereon the fire grate 19 is mounted. Here, the stationary fire grate 19 is just mounted on four integral air supply pipings of the ash sifting lower body. Securing of the fire grate 19 in place is done by placing the upper incineration chamber body on top of the apparatus of lower ash sifting lower body with the fire grate 19 thereon such that the outer plain-circular rim of the fire grate 19 is mated and fitted in place by a lower circular ring flange of the upper incineration chamber body and by the inner shell of the water jacket of the ash sifting lower body. Also revealed is the configuration of four integral air supply pipings, one end of each of which is welded to a junction body 12*a* and the other two air piping open tips to the torus air plenum 2*a*. Since each air jet vector of air openings 18*a*, 18*b* on the two air pipings 14*a*, 14*b* of the integral air supply piping clearly shown in FIGS. 4–12 and 15–17 makes certain angle with horizontal line and are spaced radially such that the radial positioning of the air openings 18*a*, 18*b* corresponds to that of the ash discharge openings on the fire grate 19.

Figure 3:
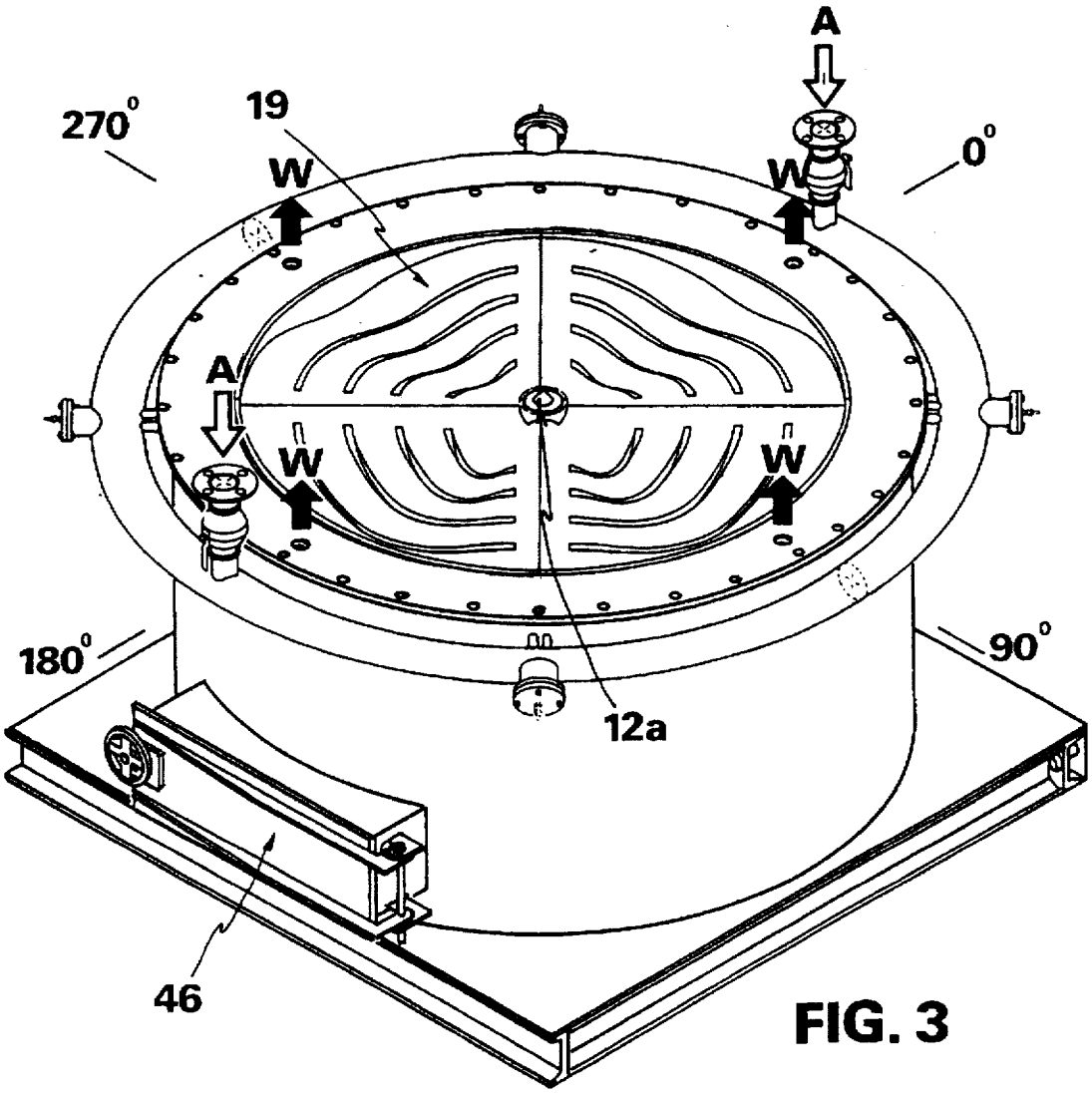
FIG. 3 is a bird's eye view of the ash sifting lower body with the stationary fire grate of FIG. 2 mounted thereon.

FIG. 3, is a bird's eye view of the ash sifting lower body with the stationary fire grate 19 mounted thereon. The figure shows a perspective view of an embodiment of a 4-cycle mode fire grate 19 mounted on the four integral air supply pipings welded radially to inner and outer shells of the ash sifting lower body. Additionally, as the upper surface profile of the fire grate 19 is of periodic fluctuational profile in circumferential direction of the fire grate, say sinusoidal profile as shown in FIGS. 4–9, extra space for air admission is inherently provided compared with conventional plain circular plate type fire grate so that more thorough supply of combustion supporting air is possible even without having complicated and expensive agitational moving grates. The refuse burning ash is sifted through a plurality of arc-shaped ash discharge openings of the same number of fluctuational cycle in this embodiment of the fire grate 19. The figure also shows combustion air influx and coolant water efflux out of the ash sifting lower body. Here, "W" refers to coolant water and "A" pressurized air.

Figure 4:
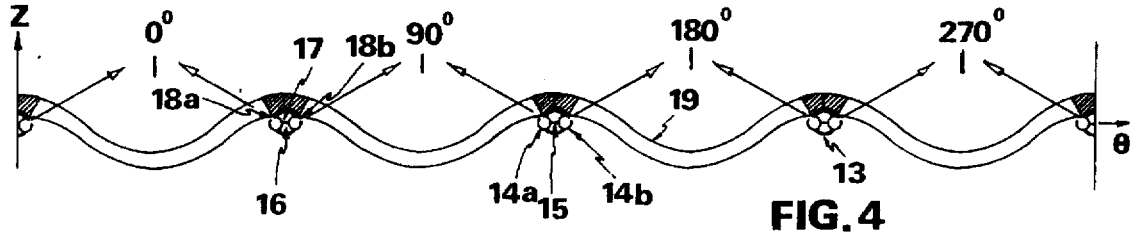
FIG. 4 is a circumferentially-developed schematic longitudinal sectional view showing the embodiment of the stationary fire grate of FIG. 2 having a sinusoidal upper surface profile of the fire grate in circumferential direction, the stationary fire grate being mounted on four air supply pipings.

FIG. 4 is a circumferentially-developed schematic longitudinal sectional view showing a 4-cycle mode embodiment of the fire grate 19 of FIG. 2 having a sinusoidal upper surface profile mounted on the four integral air supply pipings laid out radially and disposed in circumferential direction at 90 deg. angular interval according to the 4-cycle mode embodiment of the ash sifting lower body. Here, the abscissa and ordinate indicates angular and axial coordinate respectively and the view is taken from inside of the ash-sifting lower body towards outside.

Figure 5:
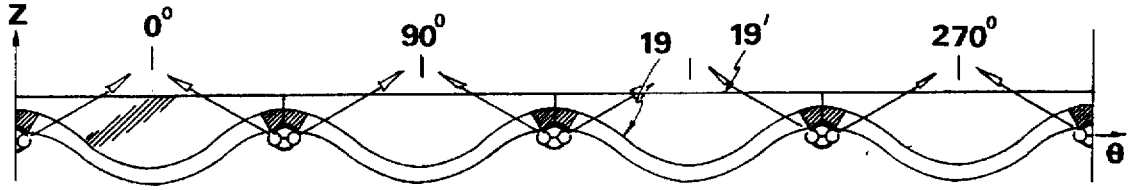
FIG. 5 is a circumferentially-developed schematic longitudinal sectional view showing fluctuation-free horizontal contour of fin upper surface of a first ring-shaped fin disposed on the upper surface of the fire grate of FIG. 4.
Figure 13:
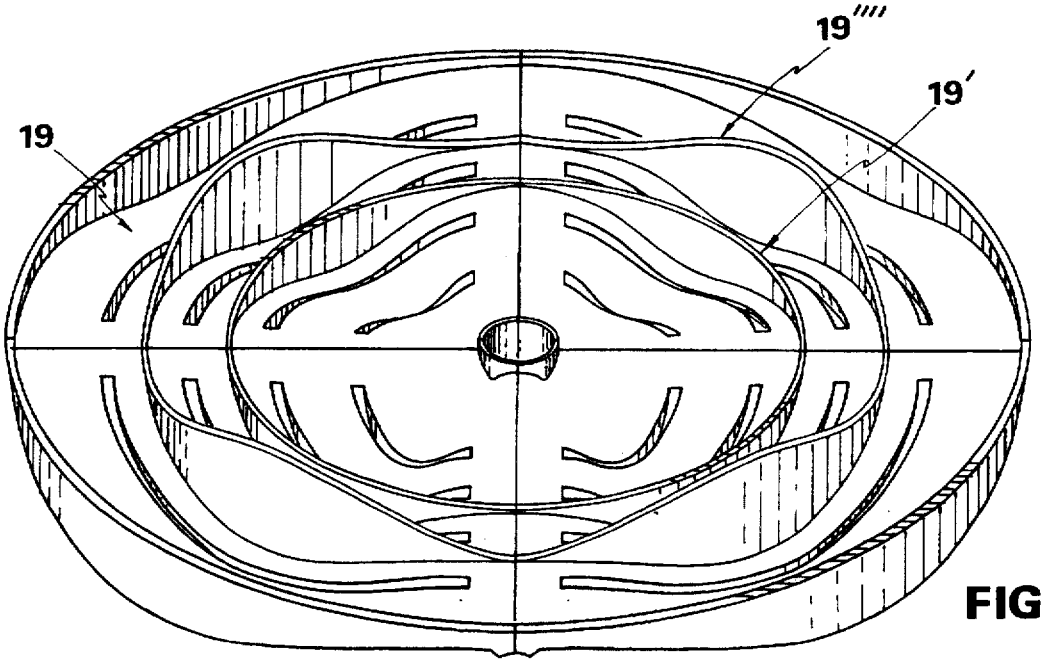
FIG. 13 is a perspective view of an embodiment of the fire grate according to the present invention having a sinusoidal periodic fluctuational profile of the fire grate upper surface with two fin embodiments of FIG. 5 and FIG. 8 disposed on the fire grate upper surface.

FIG. 5 is a circumferentially-developed schematic longitudinal sectional view showing fluctuation-free horizontal contour of fin upper surface of a first ring-shaped fin 19' disposed on the upper surface of the fire grate of FIG. 4 at a certain radial position with respect to the center of the circular fire grate. Since there is no rigorous agitational feature provided to this fire grate, it is optionally necessary for a certain group of refuse fuels to be incinerated on top of the fire grate that means corresponding to the agitational mechanism be provided to the stationary fire grate to enhance combustion efficiency. A perspective view of the application of this first ring-shaped fin embodiment is shown in FIG. 13.

Figure 6:
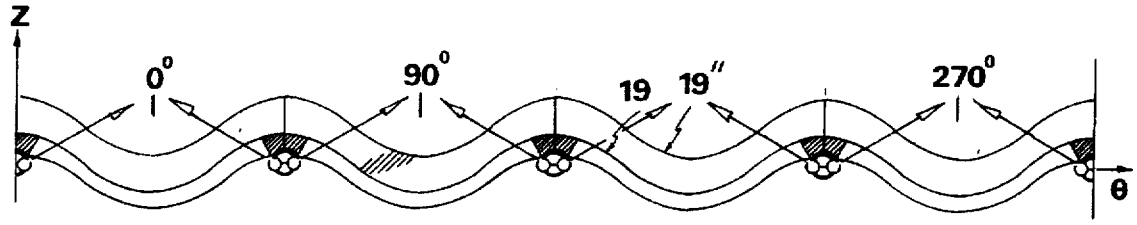
FIGS. 6–9 is a circumferentially-developed schematic longitudinal sectional view disclosing periodic fluctuational contour of fin upper surface of each of four second ring-shaped fins disposed on the upper surface of the fire grate of FIG. 4 respectively.

FIG. 6 is a circumferentially-developed schematic longitudinal sectional view of the fire grate having an embodiment of the second ring-shaped fin 19" thereon in accordance with the present invention, contour of the fin upper surface thereof being in phase with respect to upper surface of the embodiment of the fire grate 19 of FIG. 4.

Figure 7:
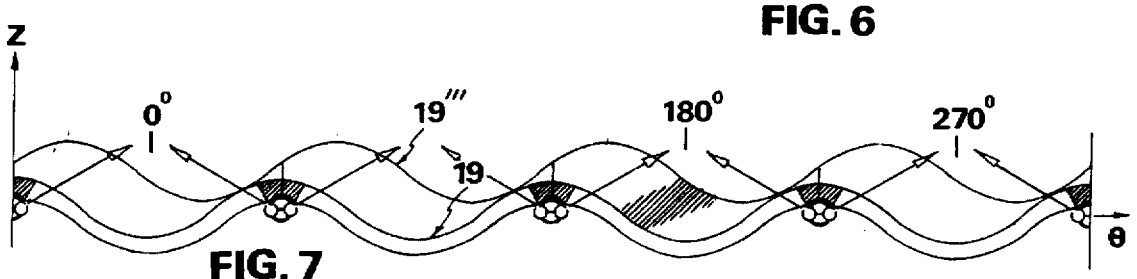

FIG. 7 is a circumferentially-developed schematic longitudinal sectional view of the fire grate having an alternative embodiment of the second ring-shaped fin 19'" thereon in accordance with the present invention, contour of the fin upper surface thereof being out of phase with respect to upper surface of the embodiment of the fire grate 19 of FIG. 4.

Figure 8:
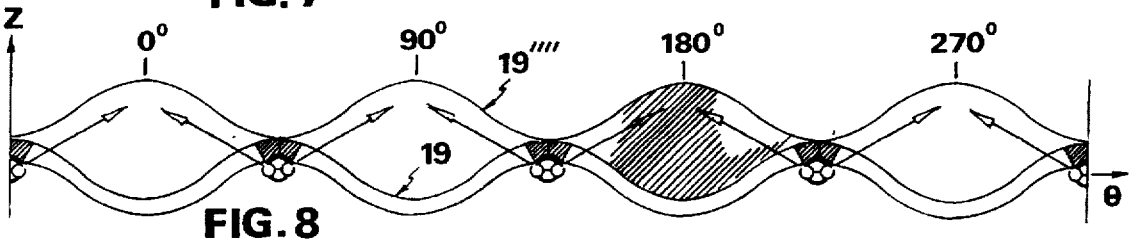

FIG. 8 is a circumferentially-developed schematic longitudinal sectional view of the fire grate having a further alternative embodiment of the second ring-shaped fin 19"" thereon according to the present invention, contour of the fin upper surface thereof having a phase shift angle of 45 deg. with respect to upper surface of the embodiment of the fire grate 19 of FIG. 4.

Figure 9:
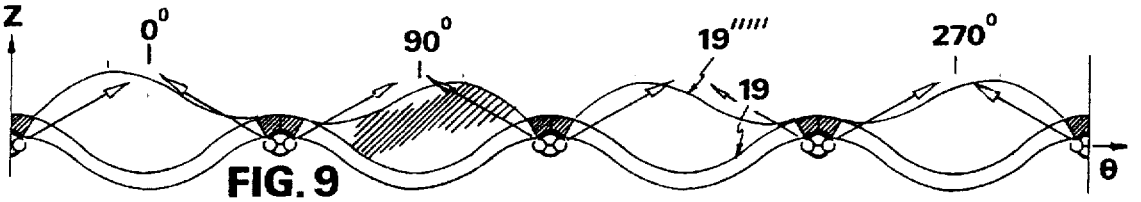

FIG. 9 is a circumferentially-developed schematic longitudinal sectional view of the fire grate having a still further alternative embodiment of the second ring-shaped fin 19"" thereon according to the present invention, contour of the fin upper surface thereof repeating every 180 deg. compared with a period of 90 deg. of fin upper surface profile repetition as in FIGS. 6–8.

Figure 10:
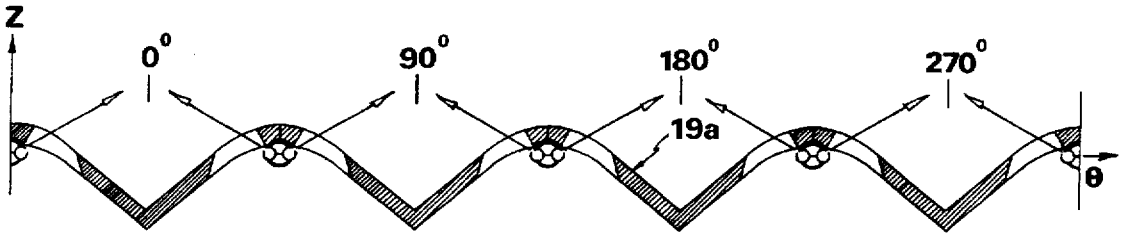
FIG. 10 is a circumferentially-developed schematic longitudinal sectional view illustrating an embodiment of the stationary fire grate having another periodic fluctuational profile of contour of the fire grate upper surface in accordance with the present invention.

FIG. 10 is a circumferentially-developed schematic longitudinal sectional view illustrating an another 4-cycle mode embodiment of a stationary fire grate 19*a* having another periodic fluctuational profile of contour of fire grate upper surface in accordance with the present invention. The contour of upper surface of the fire grate 19*a* has "V"-shaped profile segment of an angular magnitude of 45 deg. for retaining incompletely burnt waste materials such as plastic melt generated during the process of incineration. The present embodiment of the fire grate 19*a* is mounted on the four integral air supply pipings laid out radially and disposed in circumferential direction at an angular interval of 90 degs.

Figure 11:
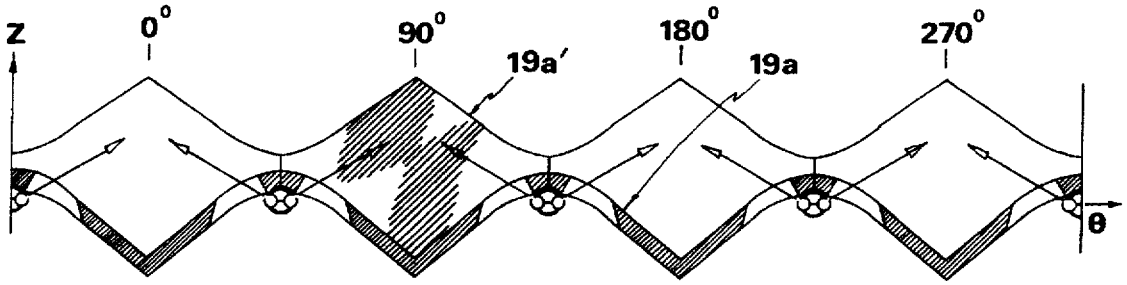
FIGS. 11 and 12 is a circumferentially-developed schematic longitudinal sectional view revealing periodic fluctuational contour of fin upper surface of each of two second ring-shaped fins disposed on the upper surface of the fire grate of FIG. 10 respectively.

FIG. 11 is a circumferentially-developed schematic longitudinal sectional view of the base fire grate 19*a* of FIG. 10 having an embodiment of the second ring-shaped fin 19*a'* of which the upper surface profile is a mirror image of that of the fire grate 19*a*.

Figure 12:
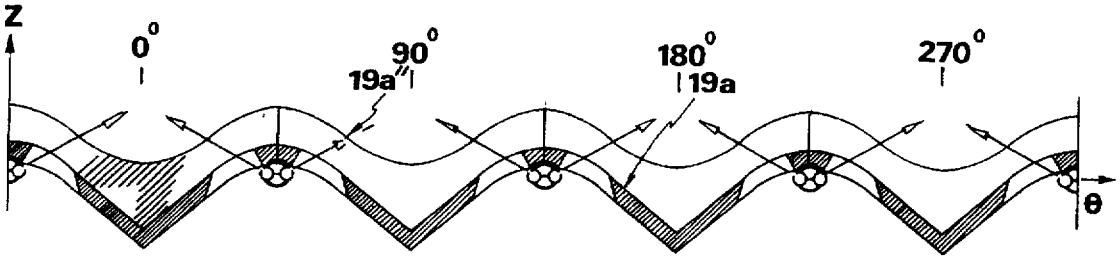

FIG. 12 is a circumferentially-developed schematic longitudinal sectional view of the fire grate 19*a* having an another embodiment of the second ring-shaped fin 19*a"* of sinusoidal fluctuational profile, which is basically the same as the fin profile 19" of FIG. 6.

FIG. 13 is a perspective view of an embodiment of the fire grate 19 according to the present invention having a sinusoidal periodic fluctuational profile of the fire grate upper surface with two fin embodiments of the fluctuation-free horizontal first ring-shaped fin 19' of FIG. 5 and of the sinusoidal fluctuational second ring-shaped fin 19"" of FIG. 8 disposed concentrically on the fire grate upper surface.

Figure 14:
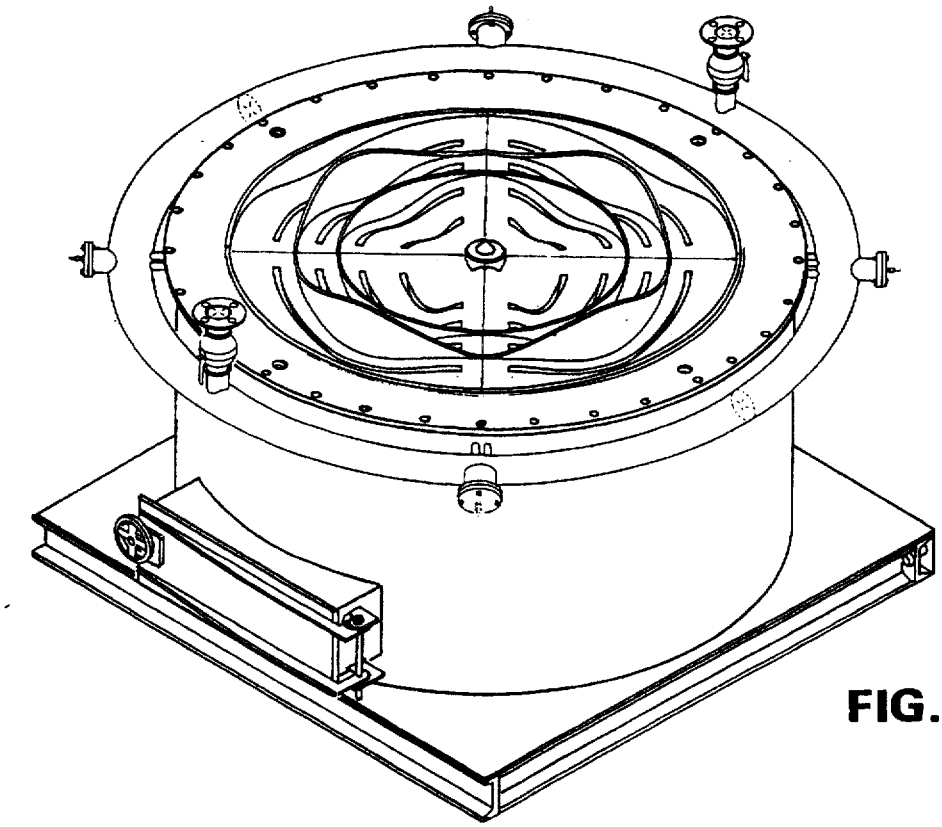
FIG. 14 is a bird's eye view of the ash sifting lower body with the stationary fire grate of FIG. 13 mounted thereon.

FIG. 14 is a bird's eye view of the ash sifting lower body with the stationary fire grate 19, 19', 19"" of FIG. 13 mounted thereon.

Figure 15:
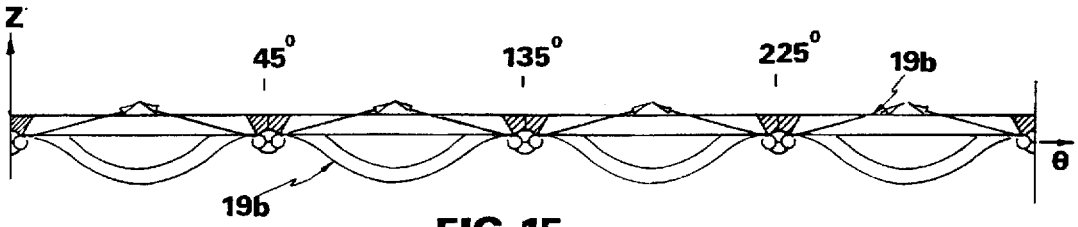
FIG. 15 is a circumferentially-developed schematic longitudinal sectional view illustrating another embodiment of the stationary fire grate in accordance with the present invention, wherein contour of upper surface is of fluctuation-free profie and of fluctuational profile in the circumferential direction of the fire grate at one radial position and at a radially neighboring position respectively.

FIG. 15 is a circumferentially-developed schematic longitudinal sectional view illustrating another embodiment of the stationary fire grate 19*b* in accordance with the present invention. This figure shows a generally circular fire grate sectored into four sectoral portions thereof. Each of the sectoral portions has therein one ash discharge opening at one radial position of the fire grate, and plan view of the opening is of essentially circular arc having center thereof at center of plan view of the fire grate 19*b*. Contour of upper surface of a radial fractional portion of the sectoral Portion is of fluctuational profile in circumferential direction of the fire grate 19*b* while a radially neighboring radial fractional portion is of fluctuation-free profile. The two radially neighboring radial fractional portions are defined by an ash-discharge opening whose plan view is of circular arc.

Figure 16:
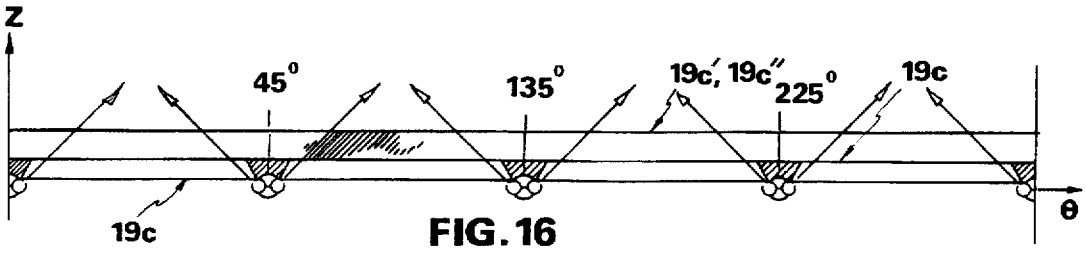
FIG. 16 is a circumferentially-developed schematic longitudinal sectional view showing still another embodiment of the stationary fire grate in accordance with the present invention whereon a ring-shaped fin having fluctuation-free horizontal fin upper surface contour is disposed.

FIG. 16 is a circumferentially-developed schematic longitudinal sectional view showing still another embodiment of the stationary fluctuation-free fire grate 19*c* in accordance with the present invention whereon a first fluctuational-free-bottom ring-shaped fin 19*c'*, 19*c"* having fluctuation-free horizontal fin upper surface contour profile is disposed.

Figure 17:
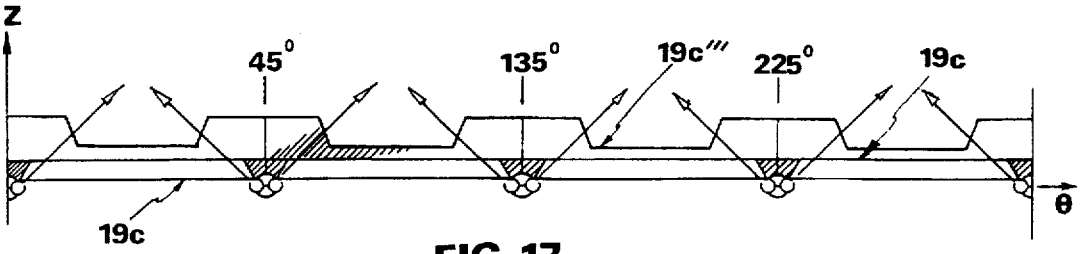
FIG. 17 is a circumferentially-developed schematic longitudinal sectional view showing the embodiment of the stationary fire grate of FIG. 16 whereon a ring-shaped fin having periodic fluctuational fin upper surface contour is disposed.

FIG. 17 is a circumferentially-developed schematic longitudinal sectional view showing the embodiment of the stationary fire grate 19*c* of FIG. 16 whereon second fluction-free-bottom ring-shaped fin 19*c'"* having periodic fluctuational fin upper surface contour profile is disposed.

Figure 18:
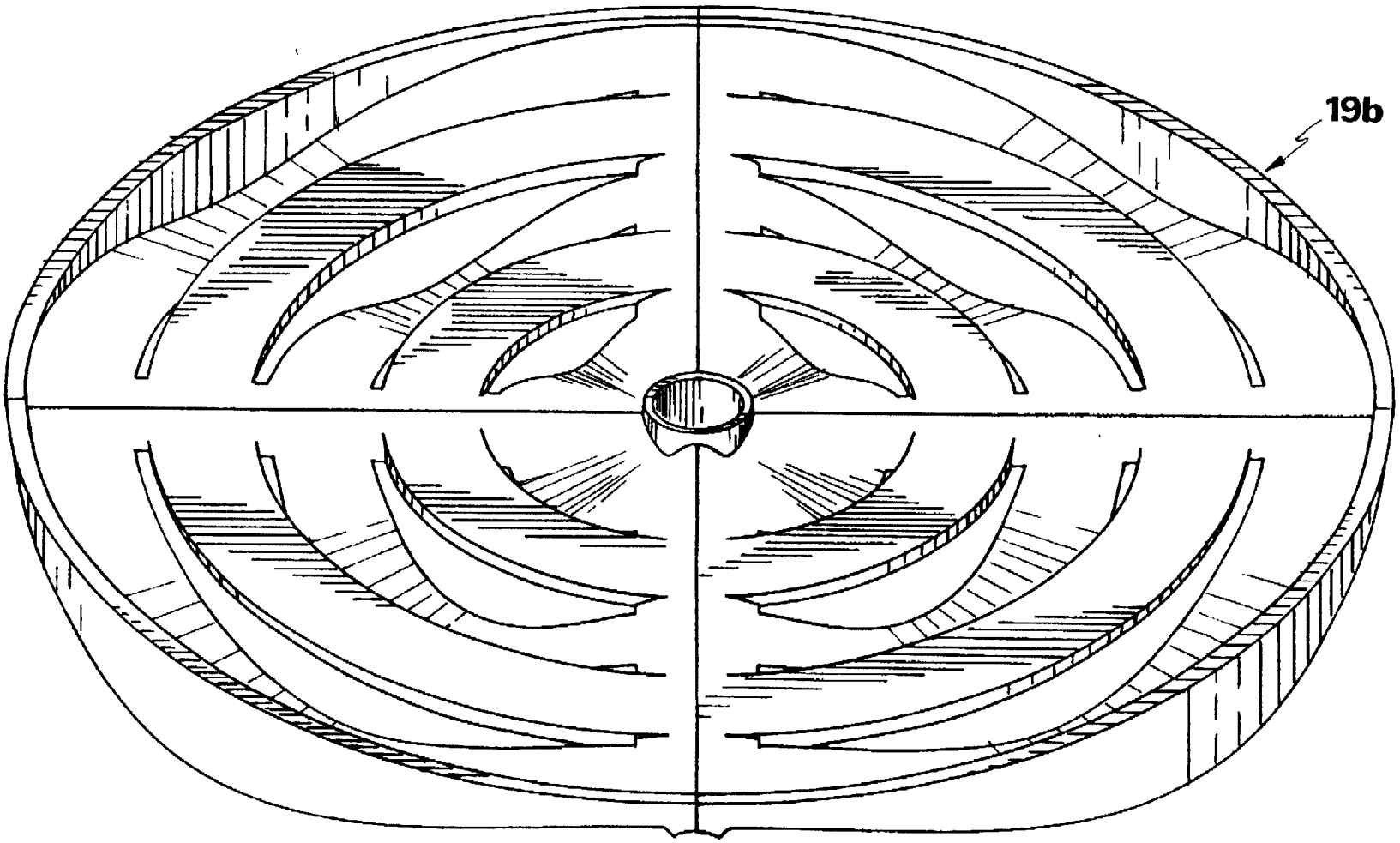
FIG. 18 is a perspective view of an embodiment of the fire grate of which circumferentially-developed longitudinal sectional view is shown in FIG. 15.

FIG. 18 is a perspective view of the fire grate 19*b* whose longitudinal sectional view at one radial position is shown in FIG. 15.

Figure 19:
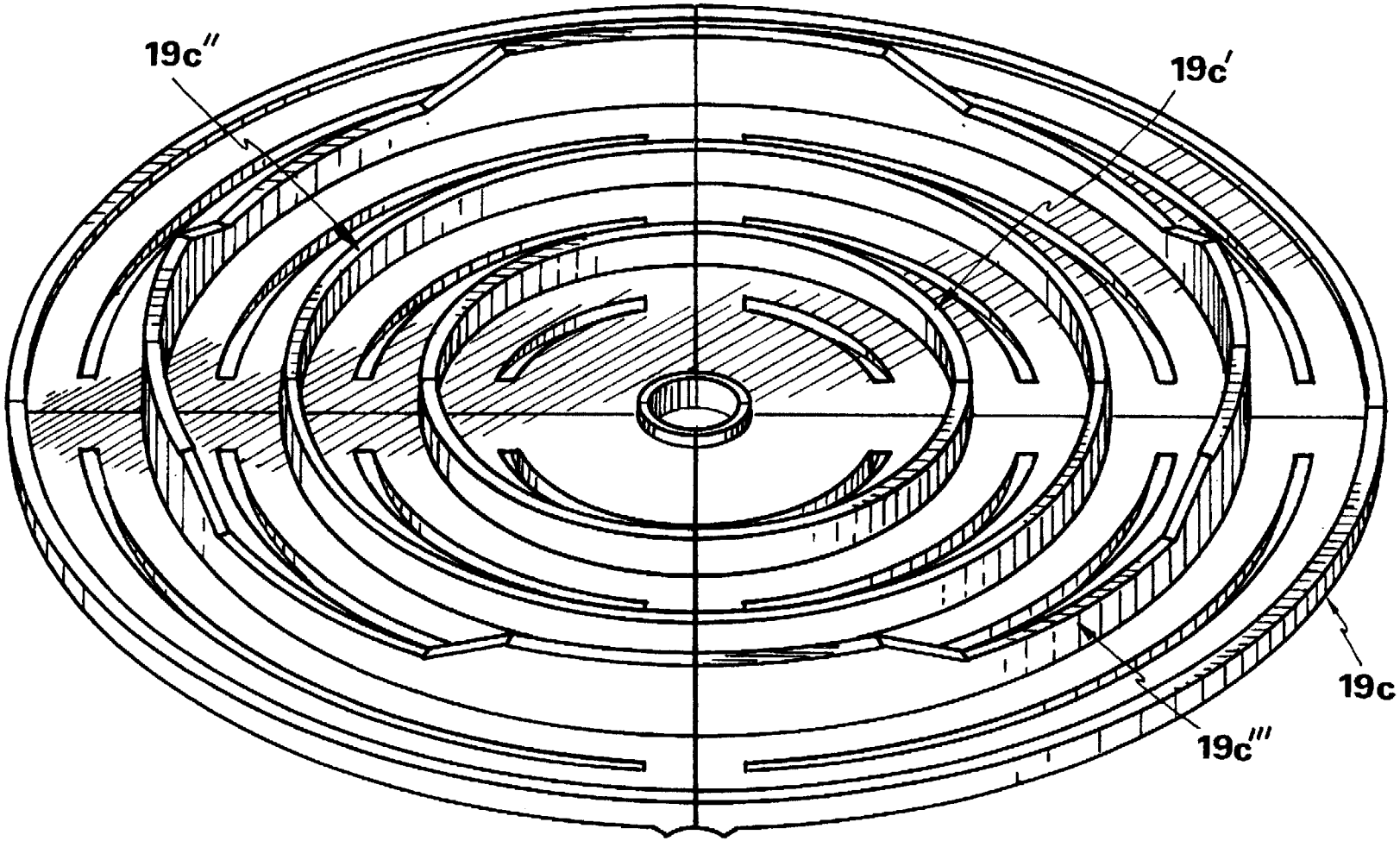
FIG. 19 is a perspective view of a circular stationary fire grate having fluctuation-free horizontal fire grate upper surface with 16 arc-shaped ash discharge openings therein and two concentric fluctuation-free ring-shaped fins of FIG. 16 and one fluctuational ring-shaped fin of FIG. 17 concentrically disposed thereon.

FIG. 19 is a perspective view of a circular stationary fire grate having horizontal fluctuation-free fire-grate upper surface with sixteen arc-shaped ash discharge openings therein and two embodiments of the first fluctuation-free-bottom ring-shaped fins 19*c'*, 19*c"* of FIG. 16 and one embodiment of the second fluctuation-free-bottom ring-shaped fin 19*c'"* of FIG. 17 thereon, all being concentrically disposed.

Figure 20:
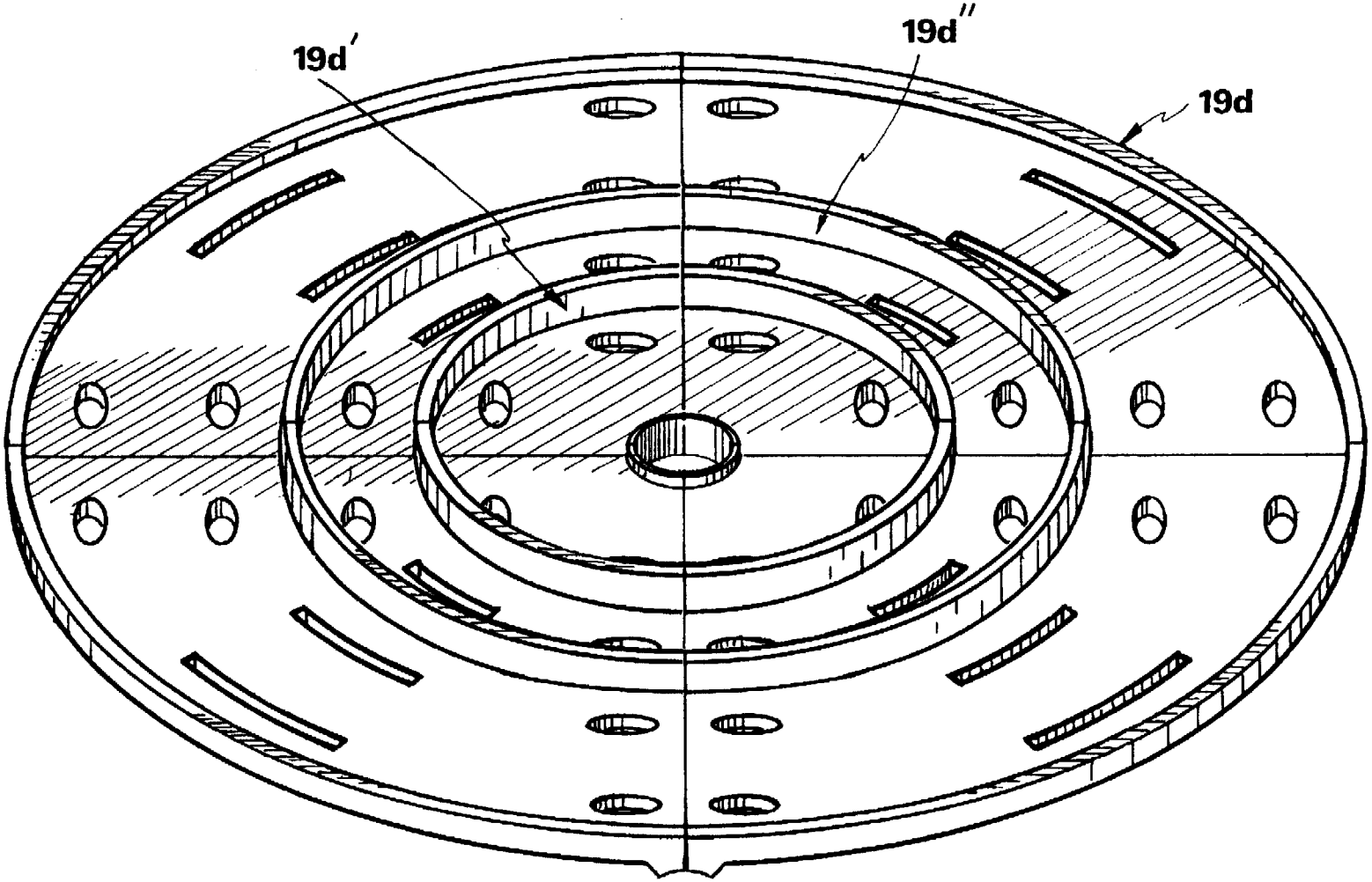
FIG. 20 is a perspective view of a circular stationary fire grate having fluctuation-free horizontal fire grate upper surface with another embodiment of ash discharge openings therein and two concentric fluctuation-free ring-shaped fins concentrically disposed thereon.

FIG. 20 is a perspective view of a circular stationary fire grate having circumferentially fluctuation-free horizontal upper surface with combustion air admission holes and ash discharge openings therein and two embodiments of the first fluctuation-free-bottom ring-shaped fins 19*d'*, 19*d"* concentrically disposed thereon. As opposed to embodiment of fire grate 19*c* of FIG. 19 having sixteen ash discharge openings therein through which combustion air admission is also made upward, this embodiment of fire grate 19*d* has separate combustion air admission holes and twelve arc-shaped ash discharge openings therein.

Figure 21:
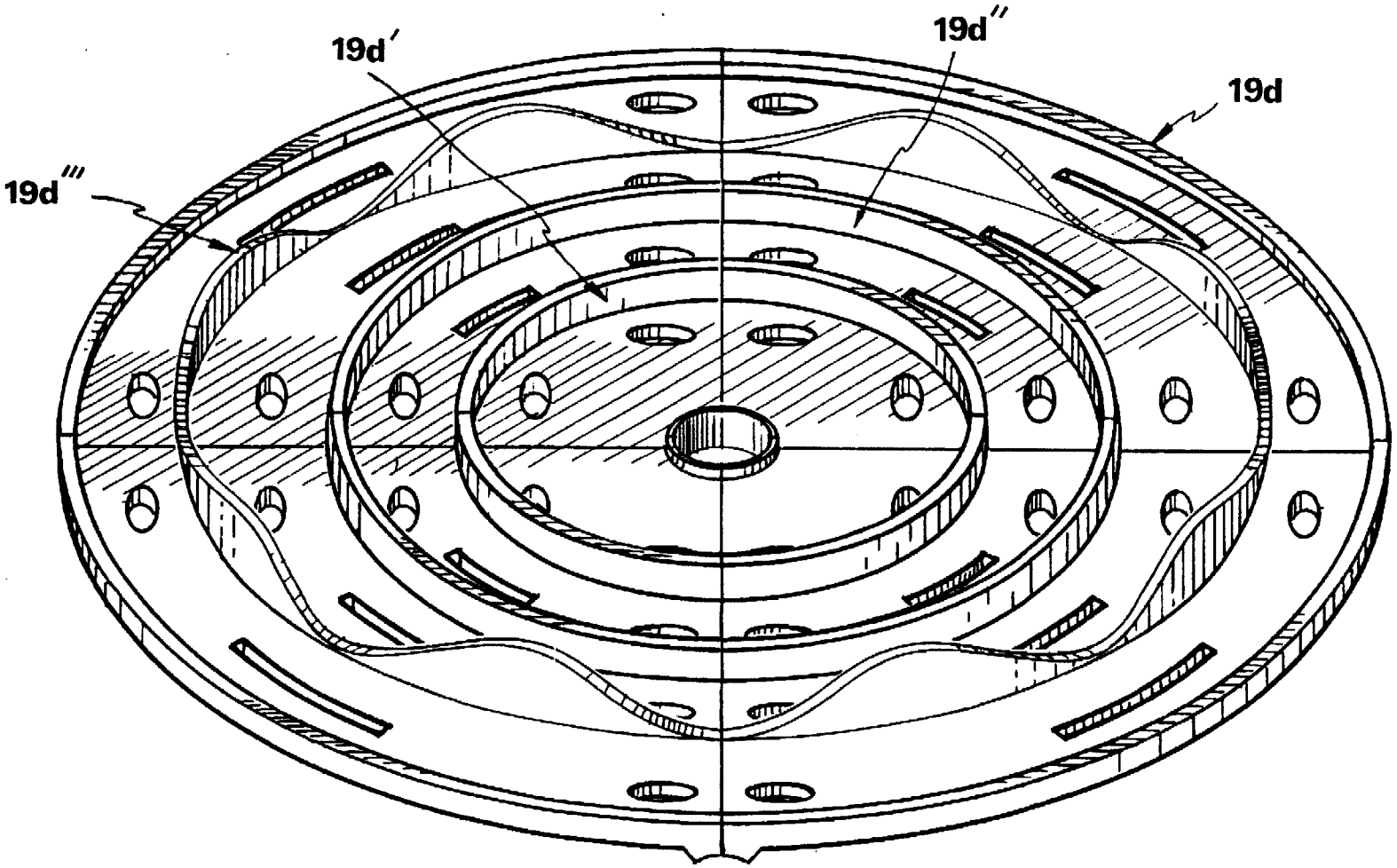
FIG. 21 is a perspective view of a circular stationary fire grate having fluctuation-free horizontal fire grate upper surface with two fluctuation-free ring-shaped fins and one fluctuational ring-shaped fin, all of the fins being concentrically disposed thereon.

Finally, FIG. 21 is a perspective view of a circular stationary fire grate 19*d* having fluctuation-free horizontal fire-grate upper surface with two fluctuation-free first fluctuation-free-bottom ring-shaped fins 19*d'*, 19*d"* and one fluctuational second fluction-free-bottom ring-shaped fin 19*d'"* thereon, all of the fins being concentrically disposed.

According to the present invention as described above in detail, intimate-contact preventing means for the waste materials on the stationary fire grate is provided to the fire grate so that airborne incineration of waste materials is possible even without rigorous agitational mechanism. More thorough air supply even into the dumped refuse is possible with this stationary fire grate selectively having fluctuational and/or horizontal fluctuation-free ring-shaped fins on the upper surface of the fire grate at certain radial spacings with ash discharge openings therein in between them resulting in increased incineration capacity and improved combustion efficiency. Even with plain circular fluctuation-free profile of the upper surface of the fire grate, lifting up feature for burning fuel airborne can be provided if fluctuation-free horizontal and/or fluctuational profile fins are disposed on the upper surface of the fire grate.

On the other hand, another aspect of the intimate-contact preventing means for the fire grate in compliance with the present invention is the fire grate having fluctuational upper surface profile in the circumferential direction of the fire grate at one radial position and fluctuation-free horizontal upper surface profile at radially neighboring radial position, the fluctuational and fluctuation-free upper surface being defined by as many arc-shaved ash discharge openings as the number of cycles of periodicity of fluctuating fire-grate under surface.

One of the advantages of the stationary fire grate in accordance with the present invention over the conventional plain circular plate type one is that the combustible liquid state materials at ambient temperature or any transitional liquid state combustible stuffs such as plastic melt at elevated furnace operating temperature can be retained, not totally but considerable percentage of them due to the presence of ash discharge openings on the fire grate, and eventually incinerated in pockets made on the fire grate, e.g., "V"-shaped pockets as shown in FIGS. 10–12, in the angular vicinity of bottom dead centers of each fluctuational profile of the upper surface of the stationary fire grate. A more thorough angular symmetry is obtained as the number of cycles of the fluctuational profile for the fire grate is increased.

As the diameter of the fire grate increases, the circumferential distance between the two angularly neighboring grate supporting means, such as solid steel pipe, triangular brackets, or the integral air supply pipings as disclosed in the drawings, increases resulting in reduced structural rigidity in radial direction of the fire grate. The reduced structural rigidity at greater radial position is compensated by having high-section-modulus fin such as the one shown in FIG. 8.

While the specific embodiment of the invention described is for 4-cycle mode fire grates, it is believed obvious to those skilled in the art that higher cycle mode stationary fire grate can readily be constructed for higher incineration capacity or for meeting specific requirements of the characteristics of waste materials to be incinerated.

Having described one embodiment each of 4-cycle mode fire grate in accordance with the invention, it is believed obvious that other modifications and variations will be suggested to those skilled in the art in the light of the above teachings. It is therefore to be understood that changes may be made in the particular embodiment of the invention described which are within the full intended scope of the invention as defined by the appended claims.

What is claimed is:

1. A circular planform stationary fire grate having a multiplicity of ash discharge openings thereon, contour of fire grate upper surface in circumferential direction and in radial direction of the fire grate being of fluctuational profile and of fluctuation-free profile respectively.

2. The fire grate of claim 1, including a first ring-shaped fin disposed on the fire grate upper surface such that axis of the first ring-shaped fin aligns with axis of the fire grate, the first fin having contour of fin upper surface of fluctuation-free profile in the circumferential direction of the fire grate.

3. The fire grate of claim 1, including at least two first ring-shaped fins disposed concentrically on the fire grate upper surface, each of the fins having contour of fin upper surface of fluctuation-free profile in the circumferential direction of the fire grate.

4. The fire grate of claim 1, including a second ring-shaped fin disposed on the fire grate upper surface such that axis of the second ring-shaped fin aligns with axis of the fire grate, the fin having contour of fin upper surface of fluctuational profile in the circumferential direction of the fire grate.

5. The fire grate of claim 1, including at least two second ring-shaped fins disposed concentrically on the fire grate upper surface, each of the fins having contour of fin upper surface of fluctuational profile in the circumferential direction of the fire grate.

6. The fire grate of claim 1, including at least one first ring-shaped fin of which contour of fin upper surface is of periodic fluctuation-free profile, and at least one second ring-shaped fin of which contour of fin upper surface is of fluctuational profile, the first and second fins being combinationally disposed concentrically on the fire grate upper surface.

7. A circular planform fire grate having horizontal and fluctuational concentric rings in combinational fashion in radial direction, the concentric rings being defined by a multiplicity of arc-shaped openings.

8. A circular planform stationary fire grate having a multiplicity of ash discharge openings thereon, contour of fire grate upper surface being of fluctuation-free profile in circumferential direction of the fire grate, and a plurality of third ring-shaped fins concentrically disposed on the fire grate upper surface, contour of fin upper surface of each of the third fins being of fluctuation-free profile.

9. A circular planform stationary fire grate having a multiplicity of ash discharge openings thereon, contour of fire grate upper surface being of fluctuation-free profile in circumferential direction of the fire grate, and a plurality of fourth ring-shaped fins concentrically disposed on the fire grate upper surface, contour of fin upper surface of each of the fourth fins being of periodic fluctuational profile.

10. A circular planform stationary fire grate having a multiplicity of ash discharge openings thereon, contour of fire grate upper surface being of fluctuation-free profile in circumferential direction of the fire grate, at least one third ring-shaped fin, contour of fin upper surface of the third fin being of fluctuation-free profile, and at least one fourth ring-shaped fin, contour of fin upper surface of the fourth fin being of periodic fluctuational profile, the third and fourth fins being combinationally disposed concentrically on the fire grate upper surface.

* * * * *

UNITED STATES PATENT AND TRADEMARK OFFICE

CERTIFICATE OF CORRECTION

PATENT NO. : 5,701,881
DATED : Dec. 30, 1997
INVENTOR(S) : Kwangsoo Hyun

It is certified that error appears in the above-indentified patent and that said Letters Patent is hereby corrected as shown below:

[57] ABSTRACT should be --

At least one ring-shaped fin is disposed on the upper surface of a variety of circular stationary fire grate having ash discharge openings therein and for use in combustion chamber of either water jacket or fire brick type cylindrical incinerators as means for preventing waste materials being burned on the upper surface of the fire grate from making intimate contact with the fire grate. The first version is a generally circular stationary grate having circumferentially fluctuational upper surface contour profile selectively with at least one fluctuational or fluctuation-free ring-shaped fin arrangements thereon. The second version of the fire grate is a generally circular fire grate sectored into at least three sectoral portions thereof, each of the sectoral portions having therein at least two ash discharge openings disposed in radial direction of the fire grate, contour of upper surface of the fire grate at one radial fractional portion thereof being of fluctuational profile in the circumferential direction while that at neighboring radial fractional portion is fluctuation-free profile. Each of the radial fractional portions is defined by ash discharge opening having arc-shaped plan view thereof. The third version is a generally circular stationary fire grate having circumferentially fluctuation-free upper surface contour profile with either at least two fluctuation-free fins or at least one fluctuational fin or with combinational fin arrangements of the two fin profiles thereon.--.

Col. 9, line 37, All of the claims should be --

1. A generally circular stationary fire grate having ash discharge openings therein, contour of fire grate upper surface in circumferential direction and in radial direction of the fire grate being of fluctuational profile and of fluctuation-free profile respectively.

UNITED STATES PATENT AND TRADEMARK OFFICE

CERTIFICATE OF CORRECTION

PATENT NO. : 5,701,881
DATED : Dec. 30, 1997
INVENTOR(S) : Kwangsoo Hyun

It is certified that error appears in the above-indentified patent and that said Letters Patent is hereby corrected as shown below:

2. The fire grate of claim 1, including a ring-shaped fin disposed on the fire grate upper surface such that center of plan view of the ring-shaped fin essentially coincides with that of the fire grate, the fin having contour of fin upper surface of fluctuation-free profile in the circumferential direction of the fire grate.

3. The fire grate of claim 1, including at least two ring-shaped fins disposed concentrically on the fire grate upper surface, each of the fins having contour of fin upper surface of fluctuation-free profile in the circumferential direction of the fire grate.

4. The fire grate of claim 1, including a ring-shaped fin disposed on the fire grate upper surface such that center of plan view of the ring-shaped fin essentially coincides with that of the fire grate, the fin having contour of fin upper surface of fluctuational profile in the circumferential direction of the fire grate.

5. The fire grate of claim 1, including at least two ring-shaped fins disposed concentrically on the fire grate upper surface, each of the fins having contour of fin upper surface of fluctuational profile in the circumferential direction of the fire grate.

6. The fire grate of claim 1, including at least one first ring-shaped fin of which contour of fin upper surface is of fluctuation-free profile in the circumferential direction of the fire grate, and at least one second ring-shaped fin of which contour of fin upper surface is of fluctuational profile in the circumferential direction of the fire grate, the first and second fins being combinationally disposed concentrically on the fire grate upper surface.

UNITED STATES PATENT AND TRADEMARK OFFICE

CERTIFICATE OF CORRECTION

PATENT NO. : 5,701,881
DATED : Dec. 30, 1997
INVENTOR(S) : Kwangsoo Hyun

It is certified that error appears in the above-indentified patent and that said Letters Patent is hereby corrected as shown below:

7. A generally circular fire grate sectored into at least three sectoral portions thereof, each of the sectoral portions having therein at least two ash discharge openings disposed in radial direction of the fire grate, plan view of each of the openings being of essentially circular arc having center thereof at center of plan view of the fire grate, contour of upper surface of at least one selected from a group consisting of (a) a radial fractional portion of the sectoral portion defined by inner rim sector of the fire grate and by innermost said opening, (b) a radial fractional portion of the sectoral portion defined by one of the openings and by its radially neighboring said opening, and (c) a radial fractional portion of the sectoral portion defined by outermost said opening and by outer rim sector of the fire grate, being of fluctuational profile in circumferential direction of the fire grate.

8. A generally circular stationary fire grate having ash discharge openings therein, contour of fire grate upper surface being of fluctuation-free profile in circumferential direction of the fire grate, and at least two ring-shaped fins concentrically disposed on the fire grate upper surface, contour of fin upper surface of each of the fins being of fluctuation-free profile in the circumferential direction of the fire grate.

9. A generally circular stationary fire grate having ash discharge openings therein, contour of fire grate upper surface being of fluctuation-free profile in circumferential direction of the fire grate, and at least one ring-shaped fin disposed on the fire grate upper surface, contour of fin upper surface of the fin being of fluctuational profile in the circumferential direction of the fire grate, center of plan view of the fin essentially coinciding with that of the fire grate.

UNITED STATES PATENT AND TRADEMARK OFFICE

CERTIFICATE OF CORRECTION

PATENT NO. : 5,701,881

DATED : Dec. 30, 1997

INVENTOR(S) : Kwangsoo Hyun

It is certified that error appears in the above-indentified patent and that said Letters Patent is hereby corrected as shown below:

10. A generally circular stationary fire grate having ash discharge openings therein, contour of fire grate upper surface being of fluctuation-free profile in circumferential direction of the fire grate, at least one first ring-shaped fin, contour of fin upper surface of the first fin being of fluctuation-free profile in the circumferential direction of the fire grate, and at least one second ring-shaped fin in the circumferential direction of the fire grate, contour of fin upper surface of the second fin being of fluctuational profile, the first and second fins being combinationally disposed concentrically on the fire grate upper surface.--.

Signed and Sealed this

Twentieth Day of October, 1998

Bruce Lehman

*Attest:*

BRUCE LEHMAN

*Attesting Officer*

*Commissioner of Patents and Trademarks*